US010544995B2

(12) United States Patent
Cho et al.

(10) Patent No.: US 10,544,995 B2
(45) Date of Patent: Jan. 28, 2020

(54) CAPILLARY PUMP ASSISTED HEAT PIPE

(71) Applicant: HAMILTON SUNDSTRAND SPACE SYSTEMS INTERNATIONAL, INC., Windsor Locks, CT (US)

(72) Inventors: Wei-Lin Cho, Unionville, CT (US); Gary A. Adamson, North Granby, CT (US)

(73) Assignee: HAMILTON SUNDSTRAND SPACE SYSTEMS INTERNATIONAL, INC., Windsor Locks, CT (US)

( * ) Notice: Subject to any disclaimer, the term of this patent is extended or adjusted under 35 U.S.C. 154(b) by 809 days.

(21) Appl. No.: 14/231,788

(22) Filed: Apr. 1, 2014

(65) Prior Publication Data

US 2015/0276324 A1 Oct. 1, 2015

(51) Int. Cl.
*F28D 15/04* (2006.01)
*F28D 15/06* (2006.01)

(52) U.S. Cl.
CPC ..... *F28D 15/043* (2013.01); *F28D 15/06* (2013.01)

(58) Field of Classification Search
CPC ..... F28D 15/0275; F28D 15/0266; F28D 15/043; F28D 15/04; F28D 15/06; F28D 15/02
See application file for complete search history.

(56) References Cited

U.S. PATENT DOCUMENTS 4,026,348 A * 5/1977 Roberts, Jr. ..... F28D 15/06 165/104.24
9,746,248 B2 * 8/2017 Semenov ..... F28D 15/04

FOREIGN PATENT DOCUMENTS

JP 06276742 A * 9/1994 ..... F25D 15/02
WO WO 2013172988 A1 * 11/2013 ..... F28D 15/043

* cited by examiner

*Primary Examiner* — Christopher R Zerphey
*Assistant Examiner* — Harry E Arant
(74) *Attorney, Agent, or Firm* — Cantor Colburn LLP

(57) ABSTRACT

A heat transport device includes a heat pipe having a capillary container having a wick and a working fluid arranged therein. A first heat source is coupled to a first end of the capillary container to define an evaporator section and a cold sink is coupled to a second end of the capillary container to define a condenser section. A capillary pump includes an evaporator and a reservoir configured to store an additional supply of working fluid. A second heat source coupled to the evaporator is configured to vaporize the working fluid arranged therein. A fluid loop couples the capillary pump to the heat pipe. Upon detection of a predetermined condition indicative that a majority of the working fluid within the heat pipe is frozen, the capillary pump is configured to supply vaporized working fluid to the heat pipe.

14 Claims, 2 Drawing Sheets

CAPILLARY PUMP ASSISTED HEAT PIPE

BACKGROUND OF THE INVENTION

This invention generally relates to temperature control of electronics, and more particularly to a heat pipe configured for use in varying heat loads and environmental heat sink conditions. The invention will naturally limit heat rejection in low heat load and cold environment and resume its heat rejection capability in high heat loads and hot environment.

The reliability and lifetime of machines using electronic components, such as semiconductor devices for example, can be increased by reducing the temperature variations imposed on the electronic components during operation. As a result, electronic components commonly require a heat exchange device for cooling during normal operation. A heat pipe, for example, is one such heat exchanger and thermally connects an electronic component to the ambient environmental with minimal thermal resistance.

The elements of a heat pipe typically include a sealed pipe, a wick structure, and a small amount of working fluid which is in equilibrium with its own vapor. The length of the heat pipe is divided into three sections: an evaporator section, a transport (adiabatic) section, and a condenser section. Heat applied to the evaporator section by an external source is conducted through the pipe wall and wick structure where it vaporizes the working fluid. The resulting vapor pressure drives the vapor through the transport section to the condenser, where the vapor condenses, releasing its latent heat of vaporization to the provided heat sink through conduction, convection, or radiation. After rejecting the heat to the condenser, the capillary pressure created by menisci in the wick pumps the liquid phase working fluid back to the evaporator section.

During cold environment operation, such as at temperatures below the freezing point of the working fluid, the working fluid may freeze inside the condenser section of the heat pipe. Over time, the working fluid may become depleted from the heat pipe evaporator rendering the standard heat pipe nonfunctional.

Even with the frozen standard heat pipe, the first heat source is prevented from dropping to an undesirable temperature; however when the heat load to the heat pipe resumes, the heat pipe will not be able to transport the heat away from the first heat source and the heat load will rise to an undesirable high temperature.

BRIEF DESCRIPTION OF THE INVENTION

According to one embodiment of the invention, a heat transport device includes a heat pipe having a capillary container having a wick and a working fluid arranged therein. A first heat source is coupled to a first end of the capillary container to define an evaporator section and a cold sink is coupled to a second end of the capillary container to define a condenser section. A capillary pump includes an evaporator and a reservoir configured to store an additional supply of working fluid. A second heat source coupled to the evaporator is configured to vaporize the working fluid arranged therein. A fluid loop couples the capillary pump to the heat pipe. Upon detection of a predetermined condition indicative that a majority of the working fluid within the heat pipe is frozen, the capillary pump is configured to supply vaporized working fluid to the heat pipe.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
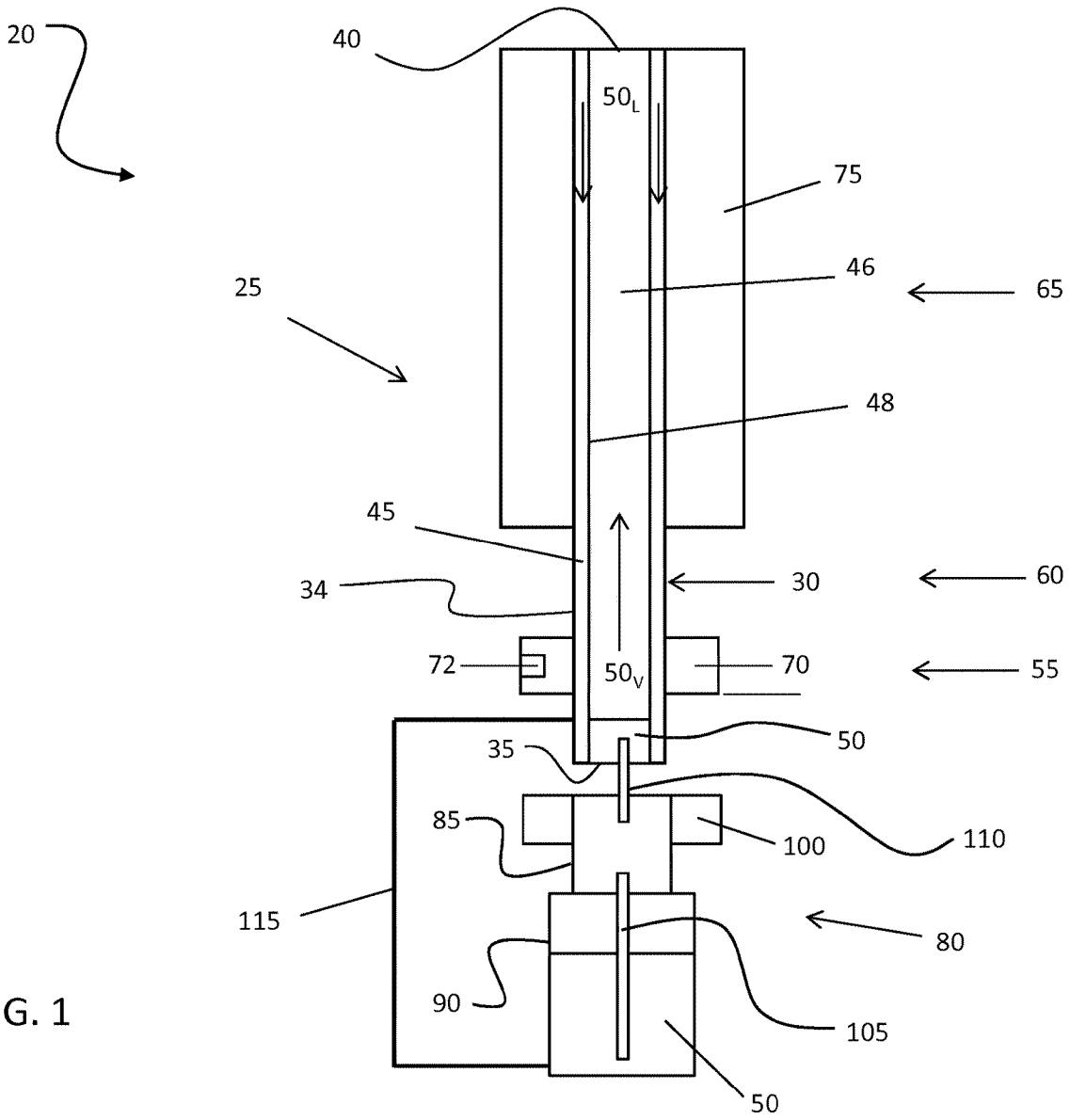
FIG. 1 is a cross-sectional view of a heat transport device operating in a first, normal mode according to one embodiment.

Referring now to FIG. 1, a heat transport device 20 configured to transfer heat away from a heat source, such as an electronic component for example, is illustrated. The heat transport device 20 includes a heat pipe 25 having a capillary container 30, such as a hollow longitudinal tube for example, including a capillary wick 45 and a working fluid 50 sealed therein. Examples of the working fluid include, but are not limited to, water, methanol, acetone, and ammonia. The container 30 may be made of a material with high conductivity, such as copper, aluminum, or an alloy thereof for example. The wick 45 may be formed by sintering metal powder on the inner surface of the container 30, by inserting curved woven mesh on the inner surface of the container 30, or by any other suitable means known to those skilled in the art.

The capillary container 30 includes an evaporator section 55 at a first end 35, a condenser section 65 at a second, opposite end 40, and an adiabatic section 60 arranged between and fluidly coupling the evaporator section 55 and the condenser section 65. A first heat source 70, such as one or more electrical components for example, is thermally coupled to the exterior 34 of the tube 30 at the evaporator section 55 adjacent the first end 35. A cold sink 75, such as a radiator face sheet, or a conductive or convective type of heat exchanger for example, is thermally coupled to the exterior 34 of the tube 30 at the condenser section 65 adjacent the second end 40.

The heat transport device 20 additionally includes a capillary pump 80 arranged adjacent and fluidly coupled to the first heat pipe 25. The illustrated capillary pump 80 includes an evaporator 85 and a reservoir 90 for storing additional working fluid 50, the working fluid 50 being substantially identical to the working fluid 50 within the heat pipe 25. A second heat source 100, such as a heat exchanger or another electrical component for example, is thermally coupled to evaporator 85 of the capillary pump 80. A first conduit 105 within the capillary pump 80 extends between the reservoir 90 and the evaporator 85 to supply working fluid thereto. A second fluid conduit 110 provides a fluid flow path from the evaporator 85 of the pump 80 to the evaporator section 55 of the heat pipe 25. A third fluid conduit 115 fluidly couples the evaporator section 55 of the heat pipe 25 and the reservoir 90 of the capillary pump 80 such that together the first, second, and third fluid conduits 105, 110, 115 form a fluid loop configured to circulate working fluid 50 between the reservoir 90 of the capillary pump 80 and the heat pipe 25.

When the temperature of the environment surrounding the heat transport device 20 is above the freezing temperature of the working fluid 50, the heat transport device 20 operates in a first, normal mode. In a normal mode, heat is generated by the first heat source 70 connected to the evaporator section 55 of the heat pipe 25. The working fluid 50 within the evaporator section 55 of the capillary container 30 absorbs the heat and vaporizes. The vaporized working fluid $\mathbf{50}_V$ is transported via a central channel 46 of the container 30 through the adiabatic section 60 to the condenser section 65. Within the condenser section 65, heat from the vapor dissipates through the cold sink 75, causing the vaporized working fluid $\mathbf{50}_V$ to condense into a liquid. The wick 45 provides a capillary force that drives the liquefied working fluid $\mathbf{50}_L$ in the condenser section 65 back to the evaporator section 55 along the sides 48 of the wick 45. In this way, the working fluid 50 moves within the tube 30 of the heat pipe 25 in a circulatory manner to transfer heat generated by the first heat source 70 from the evaporator section 55 to the condenser section 65. When in the normal mode, the capillary pump 80 of the heat transport device 20 is non-operational such that no working fluid 50 flows between the pump 80 and the heat pipe 25. In addition, the second heat source 100 may or may not be configured (e.g., via suitable electronic and/or thermal controls) to supply heat to the evaporator 85 of the capillary pump 80 in the normal mode.

Figure 2:
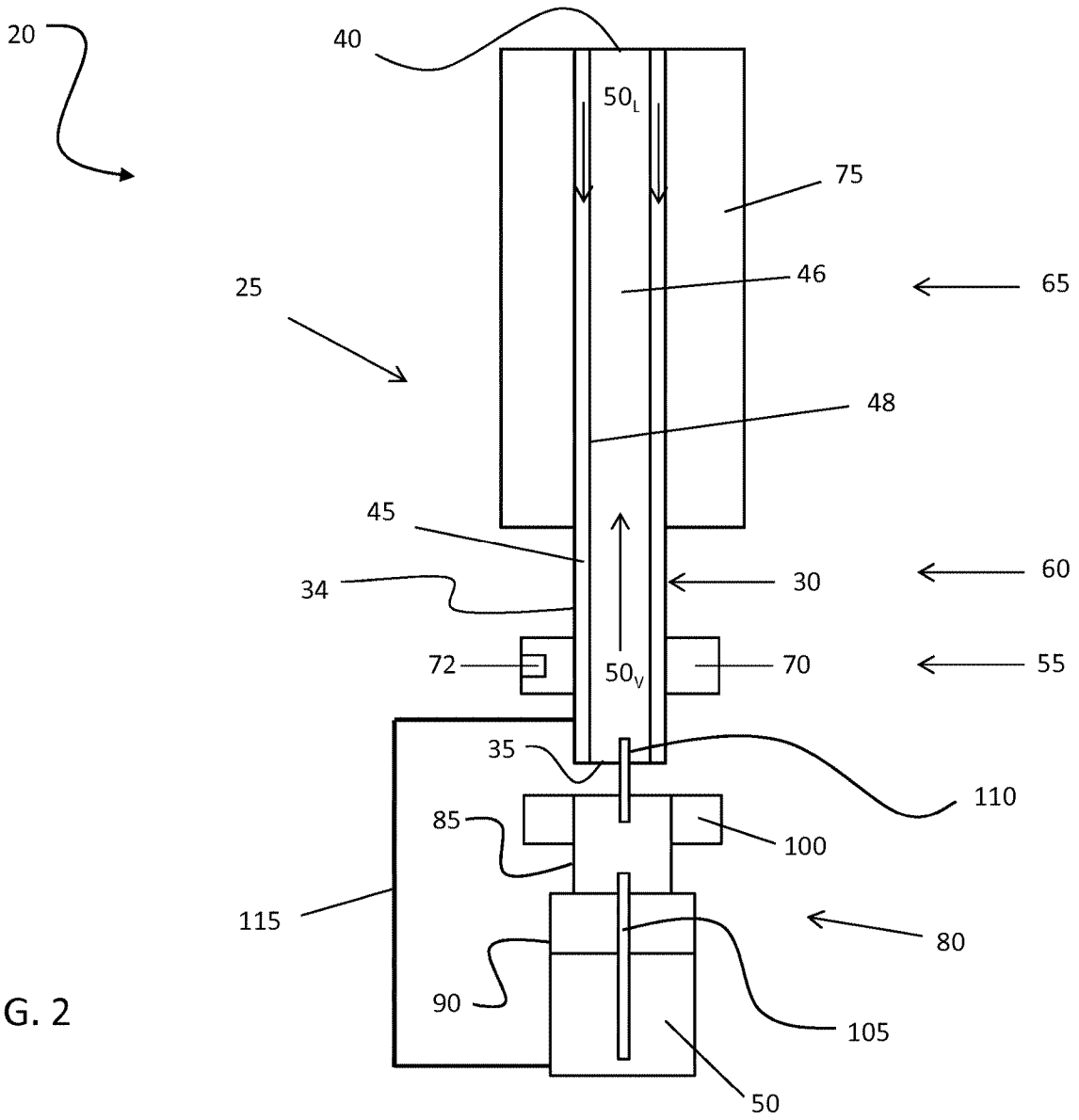
FIG. 2 is a cross-sectional view of a heat transport device operating in a second, thaw mode according to one embodiment.

When the temperature of the environment surrounding the heat transport device 20 is lower than the freezing temperature of the working fluid 50 and the heat load supplied by the first heat source 70 to the evaporator section 55 decreases, stops, or is otherwise insufficient to keep the working fluid 50 in a liquid state, the liquid working fluid 50 within the condenser section 65 can freeze in the wick 45 (FIG. 2). Over time, all or the majority of the working fluid 50 within the heat pipe 25 will freeze within the condenser section 65, thereby depleting the working fluid 50 and rendering the heat pipe 25 nonfunctional.

To resume (or continue) operation of the heat pipe 25, the heat transport device 20 is configured to operate in a second, thaw mode. In the thaw mode, the second heat source 100 coupled to the evaporator 85 of the capillary pump 80 is initiated to supply heat thereto. In the second, thaw mode, the first heat source 70 connected to the heat pipe 25 may continue to supply heat to the evaporator section 55, or alternatively, may be deactivated. In one embodiment, the first heat source 70 includes a sensor 72, such as a temperature sensor for example. The sensor 72 detects a predetermined condition indicative that a majority of the working fluid 50 in the heat pipe 25 is frozen. For example, the sensor may be configured to detect an increase in the heat load of the heat pipe 25, or alternatively, an increase in the temperature of the first heat source 70, both of which occur when the heat pipe 25 fails to reject heat. The sensor 72 may be configured to operate as a switching indicator to transform operation of the heat transport device 20 between the first normal mode and the second thaw mode when a measured value reaches a predetermined threshold.

In the second, thaw mode, working fluid 50, supplied to the evaporator 85 from the reservoir 80 via the first fluid conduit 105, absorbs heat from the second heat source 100 and vaporizes. The vaporized working fluid 50 passes through the second fluid conduit 110 into the first end 35 of the container 30 and flows through the center channel 46 of the wick 45 as previously described. Once the vapor reaches the condenser section 65, a portion of the heat is rejected through the cold sink 75, and a portion of the heat is absorbed by the working fluid 50 frozen to the walls 48 of the wick 45, causing such frozen fluid to melt and return to a liquid state. Once the liquefied working fluid 50 flows back to the evaporator section 55 through the wick 45, the working fluid 50 is supplied through the third fluid conduit 115 back to the reservoir 90, so that the working fluid 50 may be reheated by the second heat source 100 and recirculated through the heat pipe 25. Upon detection by the sensor 72 of the first heat source 70 that the majority of the working fluid within the heat pipe 25 has melted, the heat transport device 20 is configured to return to a first, normal mode of operation.

The heat transport device 20 described herein is configured to thaw a frozen condensing section 65 of the heat pipe 25 without requiring a significant amount of additional power. When a heat transport device 20 is used individually, the normal and thaw modes may be tailored based on the heat loads and the environmental conditions of the application. By using an assembly of multiple heat transport devices 20 in an application, the assembly offers a wide range of heat transport capability by allowing a portion of the devices 20 to freeze and a portion of the devices 20 to thaw at any given time.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A heat transport device comprising:

a heat pipe including:

a capillary container including a wick and a working fluid arranged therein;

a first heat source coupled to a first end of the capillary container to define an evaporator section of the heat pipe; and a cold sink coupled to a second, opposite end of the capillary container to define a condenser section of the heat pipe at the second end such that the working fluid flows as a vapor in a first direction in the heat pipe from the evaporator section to the condenser section, and the working fluid flows in a second direction opposite the first direction in the heat pipe as a liquid from the condenser section to the evaporator section;

a capillary pump including:

an evaporator;

a reservoir containing an additional supply of working fluid and being configured to supply working fluid to the evaporator; and a second heat source coupled to the evaporator and configured to vaporize the working fluid arranged therein, and a fluid loop coupling the capillary pump to the heat pipe, wherein upon detection of a predetermined condition indicative that a majority of the working fluid within the heat pipe is frozen, the capillary pump is configured to supply vaporized working fluid from the reservoir to the heat pipe by energizing the second heat source, the fluid loop connected to the heat pipe such that vaporized working fluid exiting from the fluid loop passes the first heat source in a first direction, and condensed working fluid returning to the reservoir from the heat pipe passes the first heat source in a second direction opposite the first direction before reentering the fluid loop, the fluid loop including a first fluid conduit connecting the reservoir to the evaporator, a second fluid conduit connecting the evaporator to the heat pipe, and a third fluid conduit connecting the heat pipe to the reservoir, bypassing the second heat source, the third fluid conduit connected to the heat pipe between the first heat source and the second heat source.

2. The heat transport device according to claim 1, wherein the vaporized working fluid supplied from the capillary pump to the heat pipe is configured to melt the frozen working fluid.

3. The heat transport device according to claim 1, wherein when the majority of the working fluid within the capillary container is a liquid, the heat transport device is in a first mode.

4. The heat transport device according to claim 3, wherein when the heat transport device is in the first mode, working fluid is not circulated between the capillary pump and the heat pipe.

5. The heat transport device according to claim 3, wherein upon detection of the predetermined condition indicative that a majority of the working fluid within the heat pipe is frozen the heat transport device transforms to a second mode.

6. The heat transport device according to claim 5, wherein the heat transport device further comprises a sensor configured to detect when the majority of the working fluid within the capillary container is frozen.

7. The heat transport device according to claim 6, wherein the sensor is configured to transform operation of the heat transport device between the first mode and the second mode.

8. The heat transport device according to claim 6, wherein the sensor is coupled to the first heat source.

9. The heat transport device according to claim 1, wherein the fluid loop includes a first fluid conduit coupling the reservoir and the evaporator, a second fluid conduit extending between the evaporator and the first end of the heat pipe, and a third fluid conduit connecting the first end of the heat pipe and the reservoir.

10. The heat transport device according to claim 1, wherein the first heat source includes an electrical component to be cooled by the heat transport device.

11. The heat transport device according to claim 1, wherein the second heat source includes an electrical component to be cooled by the heat transport device.

12. The heat transport device according to claim 1, wherein a sensor is configured to monitor an increase in a heat load of the heat pipe to detect the predetermined condition indicative that the majority of the working fluid in the heat pipe is frozen.

13. The heat transport device according to claim 1, wherein a sensor is configured to monitor a temperature of the first heat source to detect the predetermined condition indicative that the majority of the working fluid in the heat pipe is frozen.

14. A heat transport device, comprising:

a heat pipe including:

a capillary container including a wick and a working fluid arranged therein;

a first heat source coupled to a first end of the capillary container to define an evaporator section of the heat pipe; and a cold sink coupled to a second, opposite end of the capillary container to define a condenser section of the heat pipe at the second end such that the working fluid flows as a vapor in a first direction in the heat pipe from the evaporator section to the condenser section, and the working fluid flows in a second direction opposite the first direction in the heat pipe as a liquid from the condenser section to the evaporator section; and a capillary pump including:

an evaporator;

a reservoir containing an additional supply of working fluid and being configured to supply working fluid to the evaporator; and a second heat source coupled to the evaporator and configured to vaporize the working fluid arranged therein, and a fluid loop coupling the capillary pump to the heat pipe, the fluid loop including:

a first loop portion connecting the evaporator to the reservoir;

a second loop portion connecting the evaporator to the evaporator section of the heat pipe, wherein upon detection of a predetermined condition indicative that a majority of the working fluid within the heat pipe is frozen, the second loop portion is configured to supply vaporized working fluid to the heat pipe via the evaporator, the vaporized working fluid flowing past the first heat source in a first direction after exiting the second loop portion; and a third loop portion configured to return condensed working fluid from the heat pipe to the reservoir bypassing the evaporator, the second loop portion connected to the heat pipe at the evaporator section of the heat pipe between the first heat source and the first end of the heat pipe, the condensed working fluid flowing past the first heat source in a second direction opposite the first direction before entering the third loop portion from the heat pipe, the third loop portion connected to the heat pipe between the first heat source and the second heat source.

* * * * *